United States Patent [19]

Henze

[11] Patent Number: 4,917,597

[45] Date of Patent: Apr. 17, 1990

[54] WAX CANDLE

[75] Inventor: Jurgen Henze, Peiting, Fed. Rep. of Germany

[73] Assignee: Schongauer Wachswarenfabrik W. Ewald & Sohn GmbH, Fed. Rep. of Germany

[21] Appl. No.: 315,995

[22] Filed: Feb. 27, 1989

[51] Int. Cl.[4] ..... F23D 3/16

[52] U.S. Cl. ..... 431/289; 431/288; 431/291

[58] Field of Search ..... 126/288, 289, 291; 362/161

[56] References Cited

U.S. PATENT DOCUMENTS

| | | | |
|---|---|---|---|
| 2,354,343 | 7/1944 | Webber et al. | 431/289 |
| 2,713,256 | 7/1955 | Oesterle et al. | 431/291 |
| 2,974,509 | 3/1961 | Penke | 431/288 |
| 4,332,548 | 6/1982 | Linton et al. | 431/289 |
| 4,507,077 | 3/1985 | Sapper . | |
| 4,568,270 | 2/1986 | Marcus et al. | 431/288 |

FOREIGN PATENT DOCUMENTS

| | | |
|---|---|---|
| 2742206 | 3/1979 | Fed. Rep. of Germany . |
| 289121 | 8/1968 | U.S.S.R. . |

OTHER PUBLICATIONS

German Language European Search Report for the Corresonding Patent Application.

*Primary Examiner*—Randall L. Green

*Attorney, Agent, or Firm*—Saidman, Sterne, Kessler & Goldstein

[57] ABSTRACT

This invention comprises a wax candle consisting of a wax insert containing a wick and a surrounding wax jacket. The combustible insert consists of a wax with a melting point between 52° C. and 56° C. and the jacket consists of a wax material with a melting point between 74° C. and 78° C.

4 Claims, 1 Drawing Sheet

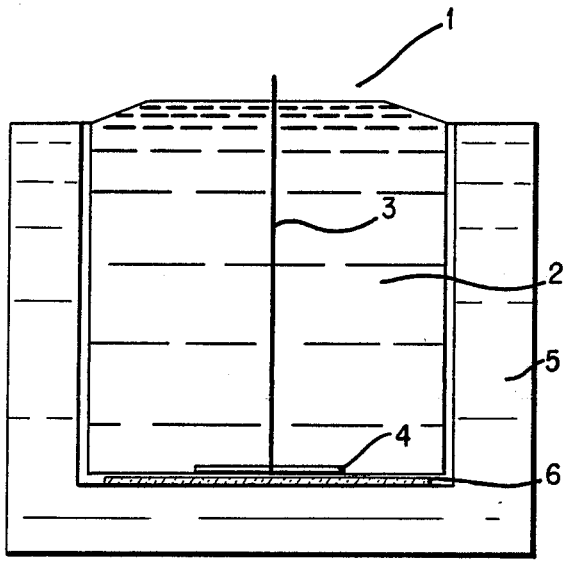
1
3
2
5
4
6

WAX CANDLE

BACKGROUND OF THE INVENTION

1. Field of the Invention

This invention is a low pollution wax candle which is not harmful to the environment.

2. Description of the Background Art

Wax candles, especially those used in churches or cemeteries, consist of a wax candle with a plastic jacketing typically made of polyvinyl chloride (PVC). However, the wax candles currently known and in use are no longer considered environmentally safe. The plastic jacketing must be removed and destroyed after use. In most instances, it cannot be reused because it has been contaminated with candle remnants or has been burned or damaged in some other manner. In practice, it is calculated that approximately 50% of the plastic jacketings are not reusable and must be disposed of by either burning or burial.

The disposal of plastic jackets, which are either difficult to burn or which release noxious byproducts (e.g., HCl) upon burning, creates environmental problems. For some plastics, such as PVC, burying is not an acceptable solution since no bacteria are known to break down PVC (i.e., it is not biodegradable). Burning PVC is, as explained above, harmful to the environment because toxic hydrochloric acid is released. The comminution of pulverization and melting down of the material are expensive processes which do not assure success.

The attainment of this invention, therefore, required a solution to the problem of finding a jacketing material which is not harmful to the environment and which can be recycled.

This problem is solved in a manner apparent from the description and claims set forth below.

BRIEF SUMMARY OF THE INVENTION

This invention comprises a wax candle comprising two parts, a wax insert and a jacket. Both parts are manufactured from materials which are not harmful to the environment. In addition, the jacket is manufactured from a material which permits simple, environmentally safe recycling.

DESCRIPTION OF THE PREFERRED EMBODIMENTS

Commercially available waxes are used for both the wax insert and the jacket, and can contain customary additives such as fillers and the like. These additives also include dyes, so that, for example, the jacket can be dyed red and the insert white. All desired combinations are therefore possible. The jacket can also be decorated on its outer surface.

The two wax materials comprising the insert and jacket can have the same base, but must have different melting points. A preferred base for this invention is paraffin. In a different embodiment, the insert may consist of animal fat (e.g., stearin) or of beeswax. This is purely a question of economics. The important thing is that the difference in melting point is maintained.

Wax candles like those used in churches or cemeteries have a wide area of application. Their dimension is not critical within the customary limits known in the art. Large wax candles can be manufactured for cemeteries. Wax candles for churches are limited in their dimensions by the requirement that they burn no longer than several hours.

The best insulator or insulating layer in the jacket is in the form of a small plate, a fabric or fleece, and should consist of a material which conducts as little heat as possible. In one embodiment, the insulator is asbestos. In another embodiment, a glass fiber fabric or fleece is used. In another embodiment, plastic such as Kevlar$^R$, which can be inserted as a small plate or a piece of fabric is used. The heat insulator can be recovered after melting the jacket and reused. Following burning of the candle, small heat-insulator plates or fabrics of this invention are removed (literally skimmed off), freed of surrounding wax, and can be reused as is. In the case of asbestos or glass fibers, disposal by burial causes no environmental problems.

Both the wax insert and jacket are manufactured using methods known in the art, Either a pressing or a casting method is preferred. They can also be manufactured by emergence and subsequent cutting or by drawing and subsequent cutting.

The wax insert can also be insulated, if a heat insulator in the jacket is to be avoided, by immersing the lower part in sodium tetrasilicate such that a heat insulator is formed either on the bottom surface or over the entire surface of the wax insert.

The wax insert is combustible and burns down to the bottom during use. The remaining jacket is collected, comminuted and remelted. In the case of dyed jackets it is important to avoid mixing of the colors. The only component that must now be discarded as scrap after burning is the cover foot, that is, the metal device to which the wick is fastened at its lower end.

The invention will now be explained with reference to the drawing (FIG. 1), in which reference is labelled as follows: (1) the wax candle; (2) the wax insert; (3) the wick; (4) the cover foot in which the wick is fastened; (5) the jacket; and (6) the insulator or insulating layer.

This invention is based on the idea that a wax candle can be produced consisting of a wax insert, that is, the candle, associated with a wax jacket instead of a plastic jacket.

The melting point of the wax jacket must be sufficiently high that the jacket does not burn as the candle burns. That is, the melting points of the two types of wax must be sufficiently different that the candle burns without liquefying the jacketing. A preferred melting point for the wax insert is in the range of 52° C. to 56° C. A preferred melting point for the jacket is in the range of 74° C. to 78° C.

This invention envisions wax candles of any possible shape, e.g., cylindrical (with or without foot), quadrilateral, hexagonal, octagonal or oval. The external form has no effect on the functioning of the candle.

The jacket should be at least 5 to 6 mm thick along the sides and at least 10 mm thick on the bottom. A thicker jacket would merely raise the cost of the wax candle without altering its function.

What is claimed is:

1. A wax candle comprising:

(a) a combustible wax insert containing a wick;

(b) a wax jacket surrounding said wax insert, wherein said wax jacket has a melting point sufficiently higher than said wax insert so that said wax jacket does not melt when said candle burns; and (c) an insulating layer contacting said wax jacket at a position beneath the attachment point of said wick.

2. The wax candle of claim 1 wherein said wax insert has a melting point between 52° C. and 56° C. and said wax jacket has a melting point between 74° C. and 78° C.

3. The wax candle of claim 1, wherein said insulating layer consists of asbestos.

4. The wax candle of claim 1, wherein said insulating layer consists of glass fiber.

* * * * *